US008661689B2

(12) United States Patent
Fathallah et al.

(10) Patent No.: US 8,661,689 B2
(45) Date of Patent: Mar. 4, 2014

(54) SHAVING CARTRIDGES HAVING A PLURALITY OF ARRAYS

(75) Inventors: Paul Fathallah, Marion, MA (US); William Thomas O'Connor, Londonderry, NH (US); Robert Harold Johnson, Melrose, MA (US)

(73) Assignee: The Gillette Company, Boston, MA (US)

( * ) Notice: Subject to any disclaimer, the term of this patent is extended or adjusted under 35 U.S.C. 154(b) by 451 days.

(21) Appl. No.: 12/729,318

(22) Filed: Mar. 23, 2010

(65) Prior Publication Data

US 2010/0288294 A1 Nov. 18, 2010

Related U.S. Application Data

(60) Provisional application No. 61/177,782, filed on May 13, 2009.

(51) Int. Cl.
*B26B 19/42* (2006.01)

(52) U.S. Cl.
USPC ..... 30/34.2; 30/50

(58) Field of Classification Search
USPC ..... 30/34.2, 50; D28/47
See application file for complete search history.

(56) References Cited

U.S. PATENT DOCUMENTS

| | | | | |
|---|---|---|---|---|
| 5,191,712 | A * | 3/1993 | Crook et al. | 30/34.2 |
| 5,590,468 | A * | 1/1997 | Prochaska | 30/41 |
| 5,689,883 | A | 11/1997 | Ortiz et al. | |
| 5,953,819 | A * | 9/1999 | Simms et al. | 30/34.2 |
| 6,216,345 | B1 | 4/2001 | Andrews | |
| 6,675,479 | B1 | 1/2004 | Walker, Jr. et al. | |
| 6,948,249 | B2 * | 9/2005 | Barone et al. | 30/41 |
| D524,986 | S | 7/2006 | Prudden, Jr. | |
| 2003/0159291 | A1 | 8/2003 | Clark | |
| 2005/0246898 | A1 | 11/2005 | Gilder | |
| 2008/0034590 | A1 | 2/2008 | Prudden, Jr. et al. | |
| 2008/0229583 | A1 * | 9/2008 | Fischer et al. | 30/34.2 |
| 2009/0193659 | A1 * | 8/2009 | Park et al. | 30/50 |
| 2010/0083510 | A1 | 4/2010 | Clarke | |

* cited by examiner

*Primary Examiner* — Stephen Choi
(74) *Attorney, Agent, or Firm* — Blaine A. Page; Kevin C. Johnson; Steven W. Miller

(57) ABSTRACT

A razor blade cartridge which has a housing with a proximal end portion, a distal end portion, and one or more blades mounted within the housing. An elongated resilient skin contacting element is joined to the proximal end portion of the housing. The elongated resilient skin contacting element has an alignment array of skin contacting members having a pattern of one or more flexible skin-engaging projections that are generally transverse to one or more of the blades and define a plurality of open channels that facilitate the generally unobstructed passage of hair to one or more of the blades during shaving. The elongated resilient skin contacting element also has at least one additional array of skin contacting members having a pattern that is different than the pattern of the alignment array of skin contacting members.

8 Claims, 6 Drawing Sheets

SHAVING CARTRIDGES HAVING A PLURALITY OF ARRAYS

CROSS REFERENCE TO RELATED APPLICATIONS

This application claims the benefit of U.S. Provisional Application No. 61/177,782, filed May 13, 2009.

FIELD OF THE INVENTION

The present invention relates to shaving razors, and more particularly, to shaving razor cartridges having a housing with an elongated resilient skin contacting element for facilitating stretching of skin in localized areas and/or facilitating the orientation and passage of hair to a blade for efficient and effective shaving.

BACKGROUND OF THE INVENTION

In general, a cartridge or blade unit of a safety razor has at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The guard may be generally rigid, for example formed integrally with a frame or platform structure which provides a support for the blades.

Guards are present on many shaving razors and are intended to stretch the skin, however these guards also have a propensity to cause the hairs to lie flat. The interaction of these guards with hair is analogous to rolling a weighted drum over grass just prior to cutting the grass with the blade of a lawn mower. The grass, similar to hair on the skin, cannot be cut effectively and efficiently if it is not oriented generally perpendicular to the blade. Hair growth varies greatly depending on the individual, as well as the area of the body being shaved. Typically short hairs are characterized as growth of approximately twenty-four hours. Standard shaving razor guards are able to cut short hairs rather effectively because the short hairs are generally stiff and are oriented generally perpendicular to the blade. As the hair grows longer it has a tendency to bend over and lay flat against the surface of the skin in an orientation that is more parallel to the blade. Standard shaving razor guards are less effective due to the orientation of longer hairs, because the blade will have the tendency to skive or cut the hair at an angle more parallel to the skin surface. Some hairs may lay flat such that the blade of the razor passes over the hairs without cutting them. The user often has to shave the same area repeatedly to cut hairs that were either uncut or not cut close enough to the skin surface, resulting in increased skin irritation.

Embodiments of the present invention may achieve one or more of the following advantages. Proper hair orientation and localized areas of skin stretching can be achieved without sacrificing the overall stretching of the skin. In addition, it is believed the various embodiments of the present invention will provide reduced nicks, improved closeness, better tactile feel during shaving, and improved overall comfort. Other advantages and features of the present invention will be apparent from the following detailed description and from the claims.

SUMMARY OF THE INVENTION

In one aspect, the invention features, in general, a razor cartridge with a housing having a proximal end portion, a distal end portion, and one or more blades mounted within the housing. An elongated resilient skin contacting element is joined to the proximal end portion of the housing. The elongated resilient skin contacting element has an alignment array of skin contacting members having a pattern of one or more flexible skin-engaging projections that are generally transverse to one or more of the blades and define a plurality of open channels that facilitate the generally unobstructed passage of hair to one or more of the blades during shaving. The elongated resilient skin contacting element also has at least one additional array of skin contacting members having a pattern that is different than the pattern of the alignment array of skin contacting members.

In another aspect, the invention features, in general, a razor cartridge with a housing and one or more blades mounted within the housing. An elongated resilient skin contacting element is joined to the housing. The elongated resilient skin contacting element has a proximal end portion and a distal end portion. A pair of lateral arrays of skin contacting members is disposed between the proximal end portion and the distal end portion. An alignment array of skin contacting members is disposed at the distal end portion of the elongated resilient skin contacting element between the pair of lateral arrays of skin contacting members. The alignment array of skin contacting members includes a plurality of flexible skin-engaging projections that are generally transverse to one or more of the blades and define a plurality of open channels that facilitate the generally unobstructed passage of hair to one or more of the blades during shaving.

In another aspect, the invention features, in general, a method of cutting hair to provide a closer and more comfortable shave. The method of cutting hair has the steps of providing a shaving razor cartridge with at least one blade and an elongated resilient skin contacting element. A first area of skin in front of the blade is stretched with the elongated resilient skin contacting element. A plurality of hairs behind of the first area being stretched is aligned with the elongated resilient skin contacting element, whereby the hairs are aligned generally perpendicular to the at least one blade. Another area of skin lateral of the hairs being aligned is stretched with the elongated resilient skin contacting element. The generally aligned hairs are cut with the one or more blades.

If, desired, particular embodiments may optionally include one or more elongated slots to improve hair orientation relative to one or more of the blades. Particular embodiments may also optionally include a skin contacting bar disposed on the housing which has a plurality generally rigid projections to provide for improved hair orientation.

DETAILED DESCRIPTION OF THE INVENTION

Figure 1:
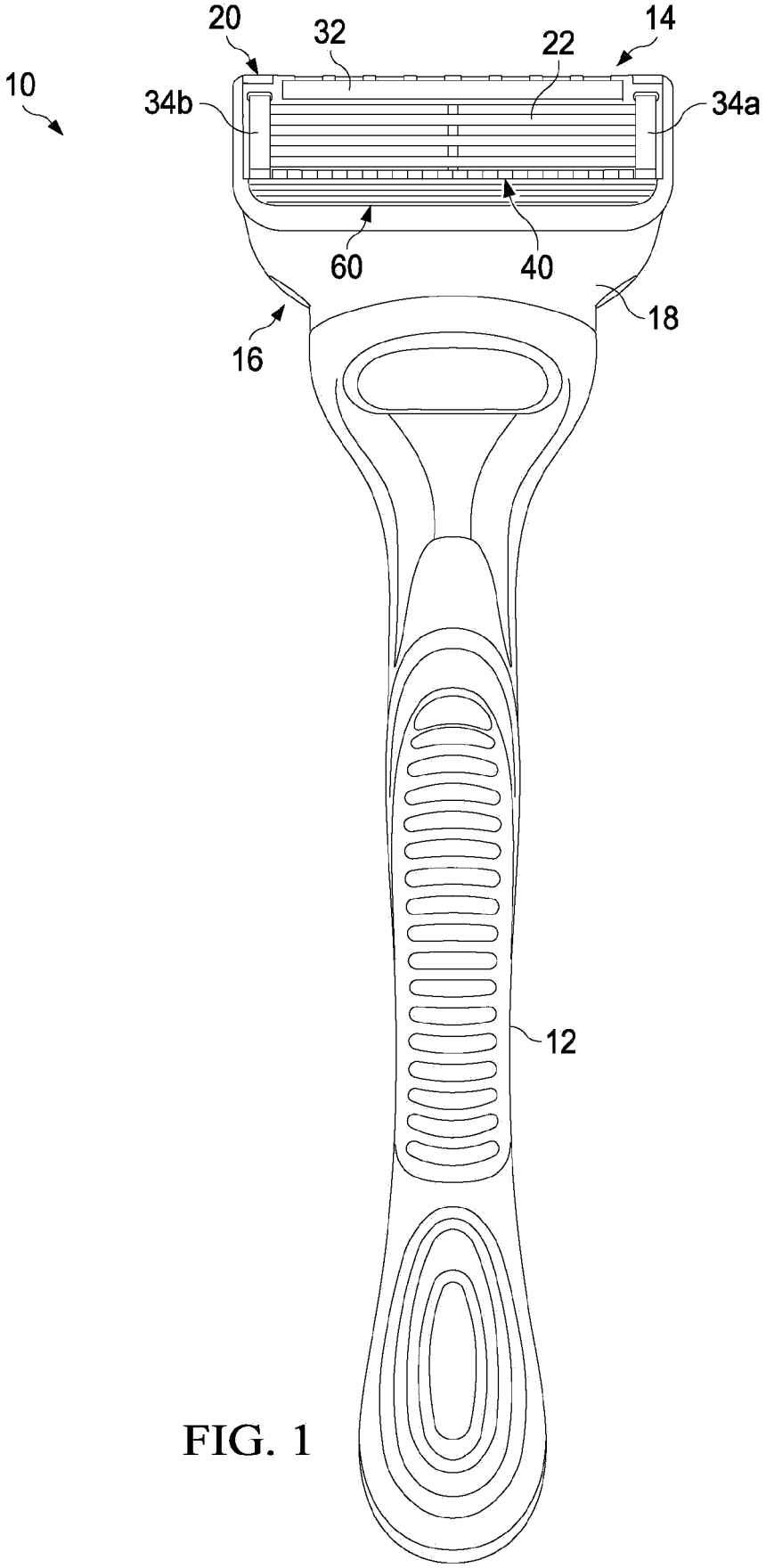
FIG. 1 is a top view of one possible embodiment of a shaving razor of the present invention.

Referring to FIG. 1, one possible embodiment of the present invention is shown illustrating a shaving razor 10 having a handle 12 and a cartridge 14. In certain embodiments, the cartridge 14 may be detached and removed from the handle 12. The cartridge 14 may be fixedly or pivotably mounted to the handle 12. The cartridge 14 may also include an interconnect member 16 to which the cartridge 14 is pivotably mounted about a pivot axis. The interconnect member 16 may include a base 18 which is connected to the handle 12. The cartridge 14 may include a housing 20 that carries one more blades 22, a cap 32, and an elongated resilient skin contacting element 60. The one or more blades 22 may be mounted within the housing 20 and secured with a pair of clips 34*a* and 34*b*. Other assembly methods known to those skilled in the art may also be used to secure the blades 22 to the housing 20 including, but not limited to, wire wrapping, cold forming, hot staking, insert molding, and adhesives. The housing 20 may include a skin contacting bar 40 positioned adjacent the elongated resilient skin contacting element 60. The skin contacting bar 40, as illustrated in FIG. 1, has a generally rectangular cross section, but any number of cross sectional shapes are possible, such as a circle, square, triangle, or oval. As will be described in greater detail below, the elongated resilient skin contacting element 60 may have several discrete arrays of skin contacting members to facilitate localized stretching and/or orientation of hair. The elongated resilient skin contacting element 60 may be used in combination with or independently of the skin contacting bar 40.

Figure 2:
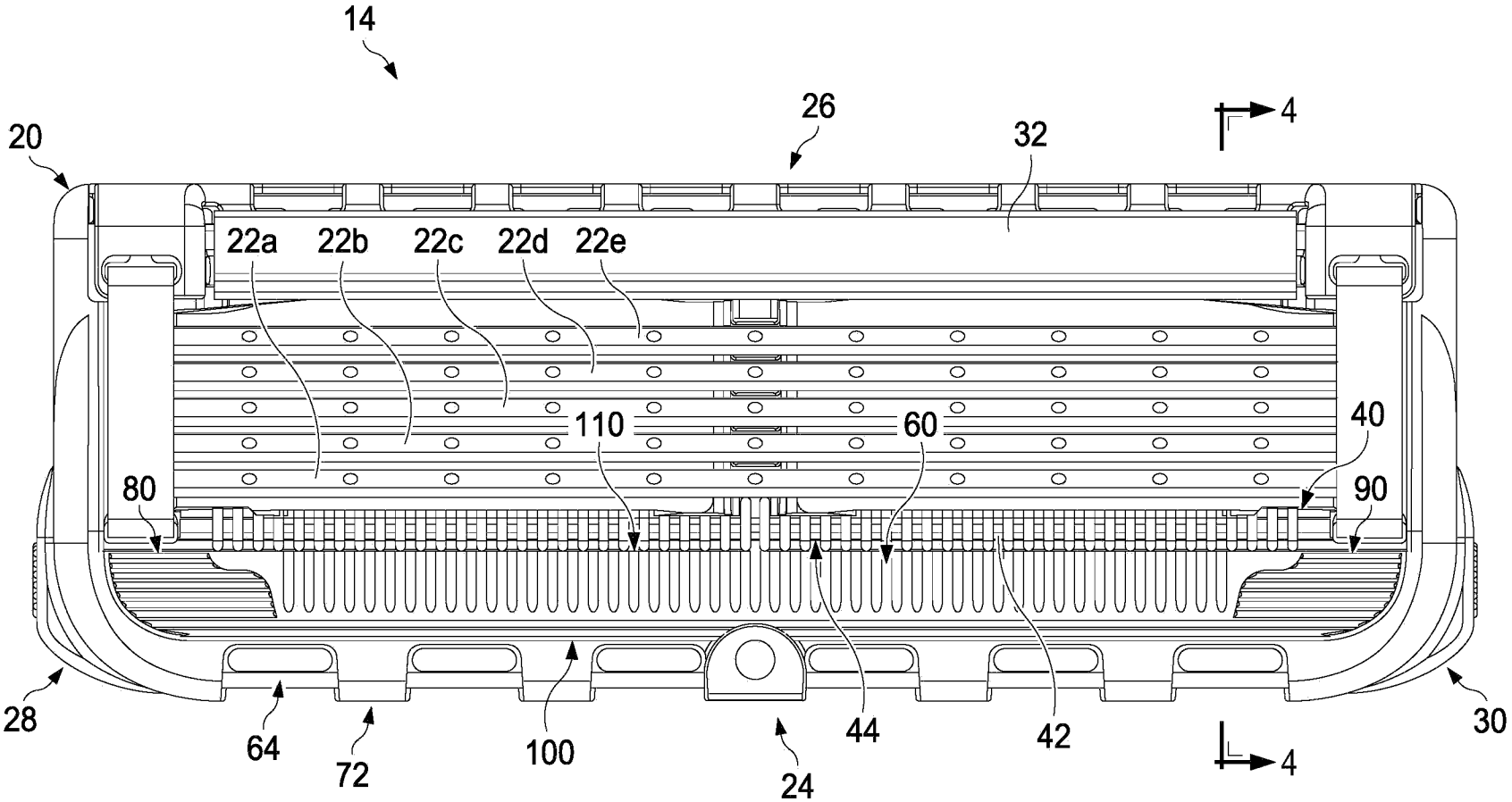
FIG. 2 is a detailed top plan view a cartridge shown in FIG. 1.

Referring to FIG. 2, a top plan view of the cartridge 14 is shown. The housing 20 may have a proximal end portion 24, a distal end portion 26, a first lateral end portion 28, and a second lateral end portion 30. The cap 32 may be disposed at the distal end portion 26 of the housing 20 and may include a lubricating strip which is secured the housing 20. The skin contacting bar 40 may be disposed at the proximal end portion 24 of the housing 20 directly adjacent to the first blade 22*a* and the elongated resilient skin contacting element 60. The blades 22*a*-22*e* may each have a respective blade edge that cuts the hair passing from skin contacting bar 40. The edge of the first blade 22*a* may be spaced apart from the skin contacting bar 40 by distance of about 0.40 mm, 0.50 mm, or 0.60 mm to about 0.75 mm, 1.25 mm, or 1.5 mm. The design of the skin contacting bar 40 may allow for a larger or smaller distance between the skin contacting bar 40 and the edge of the first blade 22*a*. In certain embodiments, the spacing between the skin contacting bar 40 and the edge of the first blade 22*a* may be less than about 0.05 mm and the skin contacting bar 40 may even touch the edge of the first blade 22*a* for improved safety.

The skin contacting bar 40 may extend longitudinally from the first lateral end portion 28 to the second lateral end portion 30 of the housing 20. A plurality of generally rigid projections 42 may extend along the skin contacting bar 40 generally perpendicular to the first blade 22*a*. The generally rigid projections 42 may be integral with or secured separately to the skin contacting bar 40. The generally rigid projections 42 may be spaced apart to define an open channel 44. The generally rigid projections 42 may be disposed along a substantial length of the skin contacting bar 40. Alternatively, the generally rigid projections 42 may extend along only certain sections of the skin contacting bar 40, such as in a middle portion or at the lateral end portions 28 and 30. The relatively large number of generally rigid projections 42 over the length of the skin contacting bar 40 may better distribute forces applied by the skin contacting bar 40 to the skin surface, especially if the skin contacting bar 40 is made from a generally rigid material. In certain embodiments, the skin contacting bar 40 may have about 20, 30, or 40 to about 60, 70, or 80 generally rigid projections 42, depending on the pitch and length of the skin contacting bar 40. The greater number of generally rigid projections 42 may also allow more hairs to pass between adjacent generally rigid projections 42, which may increase the number of hairs that are properly oriented prior to reaching the first blade 22*a*. The generally rigid projections 42 may have a pitch of about 0.20 mm, 0.40 mm, or 0.60 mm to about 0.8 mm, 1.0 mm, or 1.2 mm.

The skin contacting bar 40 may be integral with the housing 20 or may be secured to the housing 20 using mechanical, thermal or chemical manufacturing processes. The skin contacting bar 40 may be injection molded from a semi-rigid polymer material. A stiff or rigid material may allow the housing 20 to maintain a consistent geometry during shaving and enhance the ability of the generally rigid projections 42 to lift and orient hairs. The skin contacting bar 40 may be of sufficient stiffness such that the generally rigid projections 42 do not bend or flex under normal shaving conditions, which may adversely influence shave geometry. In certain embodiments, the skin contacting bar 40 may be molded from the same material as the housing 20, for example, Noryl™ (a blend of polyphenylene oxide (PPO) and polystyrene developed by General Electric Plastics, now SABIC Innovative Plastics). The skin contacting bar 40 may be molded from other semi-rigid polymers having a Shore A hardness of about 50, 60 or 70 to about 90, 110, or 120. In alternative embodiments, a segmented dynamic flexing cartridge may be provided having one or more skin contacting bars 40 each having one or more generally rigid projections 42.

The elongated resilient skin contacting element 60 may be disposed at the proximal end portion 24 of the housing 20 directly adjacent the skin contacting bar 40. The elongated resilient skin contacting element 60 may extend longitudinally from the first lateral end portion 28 to the second lateral end portion 30 of the housing 20. The skin contacting bar 40 and the elongated resilient skin contacting element 60 may be contacting or spaced apart. A first proximal end portion 72 of the elongated resilient skin contacting element 60 may define a set of ports 64 that extend completely through the elongated resilient skin contacting element 60. As will be described in greater detail below, the ports 64 may aid in removing excess shave preparation away from the cartridge 14.

The elongated resilient skin contacting element 60 may comprise a plurality of distinct arrays of skin contacting members, which may include one or more lateral arrays of skin contacting members 80 and 90, an elongated array of skin contacting members 100, and an alignment array of skin contacting members 110. The arrays of skin contacting members 80, 90, 100, and 110 can have different sizes, shapes and geometries. In particular, the arrays of skin contacting members 80, 90, 100, and 110 can be in the form of nubs or fin segments that are spaced apart or interconnected. The arrays of skin contacting members 80, 90, 100, and 110 may also have different patterns or may be oriented at different angles with respect to the blades, e.g., in zigzag, chevron, herringbone or checkerboard patterns. The arrays of skin contacting members 80, 90, 100, and 110 can also take the form of spaced fin segments that are arranged in rows oriented generally parallel to the blades or spaced fin segments that are arranged both parallel to and perpendicular to the blades.

In certain embodiments, the elongated resilient skin contacting element 60 may be insert injection molded or co-injection molded to the housing 20, however, other known assembly methods may also be used such as adhesives, ultrasonic welding, or mechanical fasteners. The elongated resilient skin contacting element 60 and the array of skin contacting members 80, 90, 100, and 110 may be molded from a softer material than the skin contacting bar 40. For example, the elongated resilient skin contacting element 60 and the array of skin contacting members 80, 90, 100, and 110 may have a Shore A hardness of about 20, 30, or 40 to about 50, 60, or 70. The elongated resilient skin contacting element 60 and the array of skin contacting members 80, 90, 100, and 110 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, the elongated resilient skin contacting element 60 and the array of skin contacting members 80, 90, 100, and 110 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 20 and/or the skin contacting bar 40 against the skin of the user during shaving.

Figure 3:
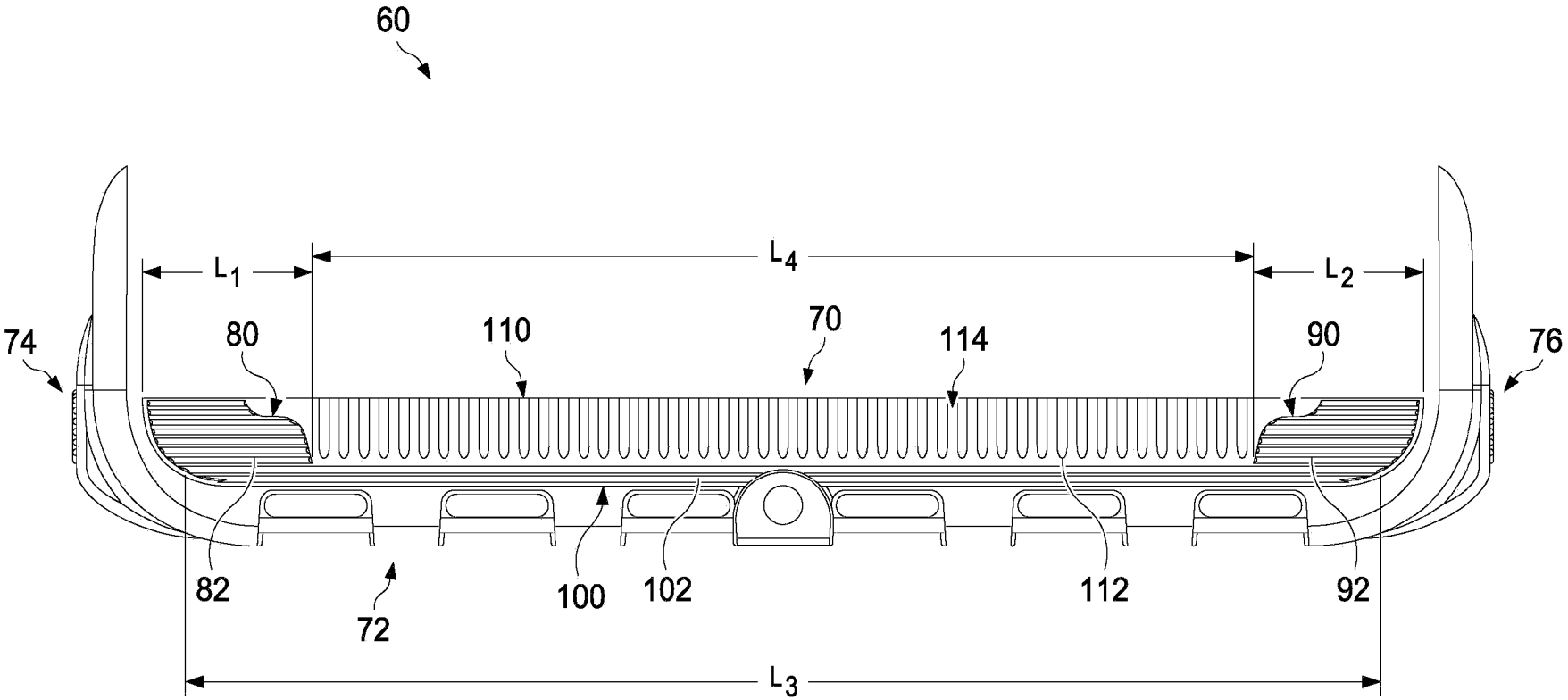
FIG. 3 is a top plan view of an elongated resilient skin contacting element of the cartridge of FIG. 2.

Referring to FIG. 3, a top plan view of the elongated resilient skin contacting element 60 is shown. The elongated resilient skin contacting element 60 may include a distal end portion 70, the proximal end portion 72, a first lateral end portion 74 and a second lateral end portion 76. The elongated resilient skin contacting element 60 may include one or more lateral arrays of skin contacting members 80 and 90. One of the lateral arrays of skin contacting members 80 may be disposed at the first lateral end portion 74 and another lateral array of skin contacting members 90 may be disposed at the second lateral end portion 76 of the elongated resilient skin contacting element 60. The lateral arrays of skin contacting members 80 and 90 may have a similar pattern, such as one or more flexible skin-engaging projections 82 and 92 that extend generally parallel to the blades. One lateral array of skin contacting members 80 may have a length $L_1$ that extends from the first lateral end portion 74 towards the second lateral end portion 76. In certain embodiments, $L_1$ may be about 0.5 mm, 1 mm, or 3 mm to about 5 mm, 7 mm, or 9 mm The other lateral array of skin contacting members 90 may have a length $L_2$ that extends from the second lateral end portion 76 towards the first lateral end portion 74. In certain embodiments, $L_1$ and $L_2$ may be generally the same, for example, $L_2$ may be about 0.5 mm, 1 mm, or 3 mm to about 5 mm, 7 mm, or 9 mm The lengths $L_1$ and $L_2$ may provide for increased skin stretching at the first and second lateral end portions 74 and 76 relative to an area between the first and second lateral end portions 74 and 76. A force applied by the elongated resilient skin contacting element 60 to the surface of the skin may not be uniform along its entire length. Additional skin stretching may be needed at the lateral end portions 74 and 76 of the elongated resilient skin contacting element 60 to provide for a more uniform skin stretching profile along the length of the elongated resilient skin contacting element 60. A more uniform skin stretching profile may result in a more consistently close and comfortable shave along the entire length of the cartridge 14, rather than a close and comfortable shave along only certain areas of the cartridge 14.

The elongated array of skin contacting members 100 may be disposed at the proximal end portion 72 of the elongated resilient skin contacting element 60 and may extend from the first lateral end portion 74 to the second lateral end portion 76. The elongated array of skin contacting members 100 may be continuous with one or more of the lateral arrays of skin contacting members 80 and 90 and may have a similar pattern, such as one or more flexible skin-engaging projections 102 that extend generally parallel to each other and/or to the blades. Alternatively, the elongated array of skin contacting members 100 may be discontinuous with the lateral arrays of skin contacting members 80 and 90 and may have a dissimilar pattern. The elongated array of skin contacting members 100 may be positioned generally on the same plane as the lateral arrays of skin contacting members 80 and 90 to provide for more uniform skin stretching. For example, if a plane of the elongated array of skin contacting members 100 was positioned below a plane of the lateral arrays of skin contacting members 80 and 90, the elongated array of skin contacting members 100 may not provide tactile sensation during shaving or apply sufficient force to stretch the skin. Insufficient skin stretching between the first and second lateral ends 74 and 76 may result in increased nicks and a less smooth shave. The elongated array of skin contacting members 100 may have a length $L_3$ that extends from the first lateral end portion 74 to the second lateral end portion 76. In certain embodiments, $L_3$ may be greater than $L_1$ or $L_2$, for example, $L_3$ may be about 20 mm, 25 mm, or 30 mm to about 35 mm, 45 mm, or 55 mm.

The alignment array of skin contacting members 110 may be disposed at the distal end portion 70 of the elongated resilient skin contacting element 60 directly adjacent to the elongated array of skin contacting members 100 and between the lateral arrays of skin contacting members 80 and 90. The alignment array of skin contacting members 110 may have a length $L_4$ that extends between the first lateral end portion 74 and the second lateral end portion 76. In certain embodiments, $L_4$ may be greater than $L_1$ or $L_2$, for example, $L_4$ may be about 10 mm, 15 mm, or 20 mm to about 30 mm, 40 mm, or 50 mm The alignment array of skin contacting members 110 may have a different pattern than the lateral arrays of skin contacting members 80 and 90 or the elongated array of skin contacting members 100. For example, the alignment array of skin contacting members 110 may include a plurality of flexible skin-engaging projections 112 that are generally transverse to the blades and define a plurality of open channels 114 that facilitate passage and orientation of hair from the elongated array of skin contacting members 100 to one or more of the blades during shaving. The flexible skin-engaging projections 112 may be disposed generally along a substantial length of the elongated resilient skin contacting element 60, for example, the alignment array of skin contacting members 110 may be disposed along about 65%, 75% or 85% to about 90%, 95% or 100% of the overall length of the elongated resilient skin contacting element 60. Although the alignment array of skin contacting members 110 is shown disposed along a substantial length of the elongated resilient skin contacting element 60, other configurations are also possible depending on the desired level and location of skin stretching and hair orientation.

The number of flexible skin-engaging projections 112 along the length of the elongated resilient skin contacting element 60 may vary, for example, the alignment array of skin contacting members 110 may have a total of about 30, 40, or 50 to about 60, 80, or 100 flexible skin-engaging projections 112, but more or less are possible depending on the pitch and length $L_4$ of the alignment array of skin contacting members 110. The flexible skin-engaging projections 112 may have the same pitch as the generally rigid projections 42, as previously described. In certain embodiments, the flexible skin-engaging projections 112 may have a pitch of about 0.20 mm, 0.40 mm, or 0.60 mm to about 0.8 mm, 1.0 mm, or 1.2 mm A larger number of flexible skin-engaging projections 112 may increase the total contact area with the surface of the skin, which may increase the amount of skin stretching, as well as increase the pleasant tactile feel to the user. The flexible skin-engaging projections 112 may also facilitate proper orientation of hairs in front of the blades. In certain embodiments, flexible skin-engaging projections 112 may not stretch the skin as much as the flexible skin-engaging projections 82 and 92. The primary function of the alignment array of skin contacting members 110 may be to direct hairs and prevent the hairs from bending over, thus the alignment array of skin contacting members 110 does not provide optimal skin stretching, as do the lateral arrays of contacting members 80 and 90. The elongated array of skin contacting members 100 may provide for additional needed skin stretching toward the center of the elongated resilient skin contacting element 60, which may compensate to provide for a more uniform stretching of skin along a length of the elongated resilient skin contacting element 60.

Figure 4A:
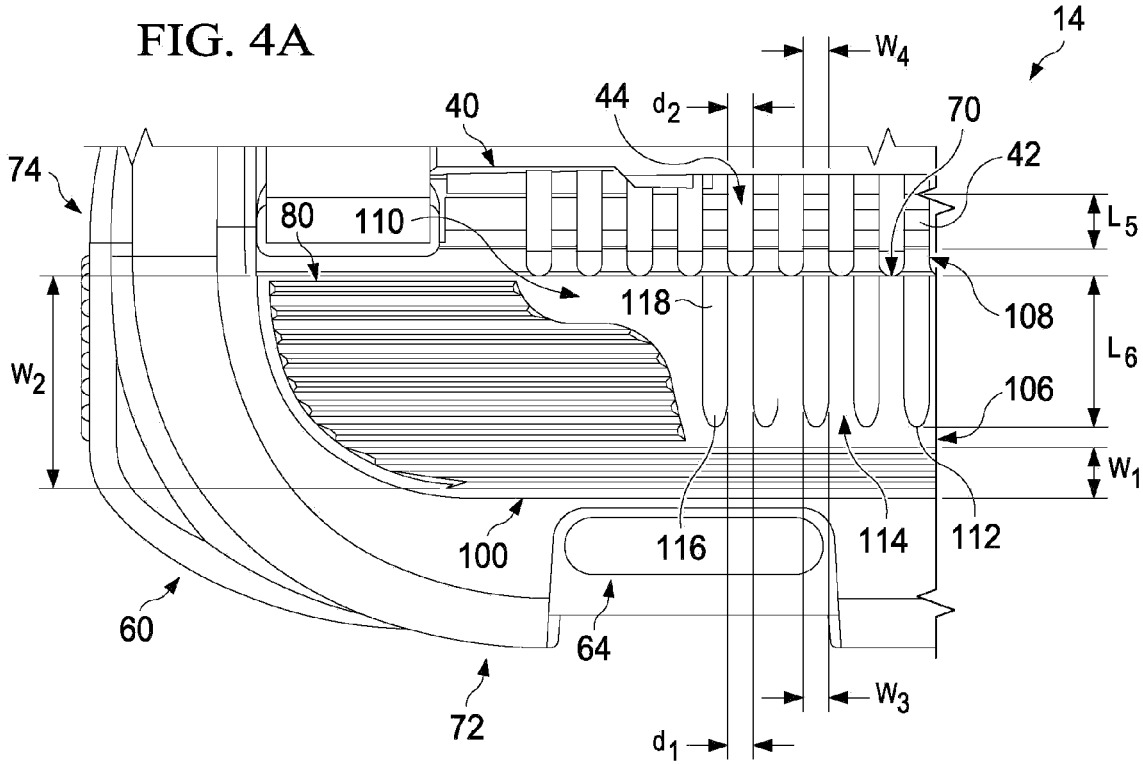
FIG. 4A is an enlarged partial top plan view of the cartridge of FIG. 2.

Referring to FIG. 4A, an enlarged partial top plan view of the cartridge 14 is shown. Typical guards only have a single pattern that is either traverse to the direction of shaving (which is not optimal for skin stretching) or is parallel to the shaving direction (which is not optimal for hair alignment and may remove too much shave preparation). The elongated resilient skin contacting element 60 has several distinct arrays of skin contacting members 80, 90, 100, and 110 which can be used in combination with the skin contact bar 40 to provide an optimum balance of skin stretching and proper hair alignment. For example, the alignment array of skin contacting members 110 may have a different length, width, orientation, or pattern compared to the elongated array of skin contacting members 100 or the lateral arrays of skin contacting members 80 and 90 to provide for optimal hair alignment. In certain embodiments, the elongated array of skin contacting members 100 may have a different length, width, orientation, or pattern compared to the lateral array of skin contacting members 80 and 90 to provide varying levels of localized skin stretching while decreasing the number of hairs that remained pressed against the skin just prior to the blades.

As the cartridge 14 glides across the surface of the skin during shaving, the elongated array of skin contacting members 100 may pre-stretch the skin and direct excess shave preparation to the ports 64. The ports 64 may remove the excess shave preparation from the area being shaved rather than pushing the shave preparation forward towards the blades, which may obstruct the blades and the elongated resilient skin contacting element 60. Shaving preparation, hair, dirt and debris may become trapped about the skin contacting bar 40 and the elongated resilient skin contacting element 60, as well as around the blades. Excess shaving preparation, hair, dirt and debris may become even more apparent for users that shave less frequently because longer hairs are more likely to become trapped and are thus more difficult to rinse out. The longer hairs would also be more likely to trap additional hairs, shaving preparation, dirt and debris. Excess cut hairs and shave preparation may decrease the ability of the elongated resilient skin contacting element 60 to stretch the skin. Excess cut hairs and shave preparation may also interfere with the ability of the skin contacting bar 40 and the elongated resilient skin contacting element 60 to properly orient hair for a close shave. If the cartridge 14 is not properly rinsed, the blades will not properly cut the hair, which may result in nicks, cuts, an increased number of uncut hairs, and a generally inefficient shave that requires more passes of cartridge 14 on the user's skin. By providing an elongated resilient skin contacting element 60 with ports 64, performance of the cartridge 14 can be enhanced by reducing excess debris, cut hairs, and shave preparation that may interfere with the function of the blades and the elongated resilient skin contacting element 60.

The elongated array of skin contacting members 100 may have a width "$w_1$" that extends generally from the ports 64 to the alignment array of skin contacting members 110. In certain embodiments, $w_1$ of the elongated array of skin contacting members 100 may be about 0.25 mm, 0.5 mm, or 0.75 mm to about 1 mm, 2 mm, or 3 mm Since the elongated array skin contacting members 100 is positioned at the proximal end portion 72 of the elongated resilient skin contacting element 60, only an excess of shave preparation is removed, leaving a thin layer of shave preparation on the surface of the skin and hairs. As the hairs pass to the alignment array of skin contacting members 110 a sufficient amount of shave preparation is left on the hairs to provide a smooth, comfortable shave. Standard guards can trap and press down hairs against the surface of the skin such that the hairs lie flat as they reach the primary or first blade (not shown). If hair becomes trapped within or under a guard, the hairs will not be presented properly to the blade(s), which may result in the blade(s) missing or skiving the. An upright hair has a greater likelihood of being cut closer by a blade than a hair that is lying flat or generally parallel to the blade. In certain embodiments, $w_1$ may be minimized to reduce the flattening of hairs.

The flexible skin-engaging projections 112 and the elongated array skin contacting members 100 may be spaced apart to define a first elongated gap 106. The first elongated gap 106 may extend generally the length of the alignment array of skin contacting members 110, but may be shorter if desired. The elongated array skin contacting members 100 may trap hair and push the hair flat against the surface of the skin The first elongated gap 106 may facilitate the release of any flat hairs back to a more upright orientation as the hair passes to alignment array of skin contacting members 110. The first elongated gap 106 may have a width of about 0 mm, 0.1 mm, or 0.2 mm to about 0.3 mm, 0.4 mm, or 0.5 mm In certain embodiments, the first elongated gap 106 may extend continuously along the length of the alignment array of skin contacting members 110, or the first elongated gap 106 may include segments that extend in a discontinuous manner along the length of the alignment array of skin contacting members 110.

The flexible skin-engaging projections 112 may have a generally rectangular or oblong geometry with a leading portion 116 and a trailing portion 118. The leading portion 116 may be tapered, rounded or have a chamfer to funnel the hair toward the blades and minimize the number of hairs that may become trapped under the flexible skin engaging projections 112. The channels 114 and the orientation of the flexible skin-engaging projections 112 may maintain a sufficient amount of shave preparation on the surface of the skin and the hair. A sufficient amount of preparation is needed to enhance hydration of the hair and decrease friction when the hair is cut by the blade(s). The channels 114 are open to allow the flow through of shave preparation instead of functioning as a squeegee which may remove too much shave preparation. The flexible skin-engaging projections 112 may also improve tracking of the cartridge 14 to prevent the cartridge 14 from sliding in a direction transverse to the direction of shaving. The lateral sliding of the cartridge 14 may lead to the blades slicing the skin resulting in severe discomfort. The leading and trailing end portions 116 and 118 may have a top surface that is generally flat to increase the total contact area with the surface of the skin, which may improve tracking of the cartridge, increase the amount of skin stretching, improve tactile feel to the user.

Adjacent flexible skin-engaging projections 112 may be spaced apart by a distance "$d_1$" to facilitate the generally unobstructed passage of hair and minimize pulling and grabbing of hair during shaving. In certain embodiments, $d_1$ may be about 0.10 mm, 0.20 mm, or 0.30 mm to about 0.35 mm, 0.40 mm, or 0.49 mm The thickness and amount of hair to be shaved may require $d_1$ to be larger or smaller depending on application. In certain embodiments, $d_1$ may taper from a wider dimension toward the proximal end portion 72 to a narrower dimension toward the distal end portion 70. The flexible skin-engaging projections 112 may have a width "$w_3$" that is generally equivalent to $d_1$, for example, $w_3$ may be about 0.10 mm, 0.20 mm or 0.30 mm to about 0.35 mm, 0.40 mm, or 0.49 mm, however, $w_3$ may also be larger or smaller depending on the desired total contact area with the skin surface. A larger contact area with the surface of the skin may result in less discomfort and may increase skin stretching.

Additional skin stretching may be provided by the lateral arrays of skin contacting members 80 and 90 (not shown) as hair passes between the flexible skin-engaging projections 112 of the alignment array of skin contacting members 110 to the skin contacting bar 40. The lateral arrays of skin contacting members 80 and 90 (not shown) may have a width "$w_2$" that is greater than $w_1$ of the elongated array of skin contacting members 100 to provide for additional localized skin stretching at the lateral ends 74 and 76 (not shown) of the elongated resilient skin contacting element 60, which may result in a more uniform skin stretching profile of the elongated resilient skin contacting element 60. For example, $w_2$ of the lateral arrays of skin contacting members 80 and 90 (not shown) may be about 0.5 mm, 1.5 mm or 2 mm to about 2.5 mm, 3 mm, or 3.5 mm.

The combination of the dimensions $w_1$ and $w_2$ and the location of the lateral arrays of skin contacting members 80, 90 (not shown) and the location of the elongated array of skin contacting members 100 may minimize the pressing of hair against the surface of skin while maximizing the stretching of skin. Skin stretching may be maximized by increasing $w_2$ without negatively effecting the orientation of hair, because the lateral arrays of skin contacting members 80 and 90 are generally positioned laterally of where the blades cut the hair. The orientation of hair can be maximized by reducing $w_1$, which may press hair against the surface of the skin. The alignment array of skin contacting members 110 may negate the pressing effect of the elongated array of skin contacting members 100 by facilitating the lifting and orientation of hair pressed against the skin The alignment array of skin contacting members 110 may allow $w_1$ to be increased and provide more stretching by minimizing the number of hairs that remain pressed against the surface of the skin during shaving.

The skin contacting bar 40 and the alignment array of skin contacting member 110 may define a second elongated gap 108. The second elongated gap 108 may extend generally the length of the skin contacting bar 40, but may be shorter if desired. Any hairs that do not pass along the channels 114, but may be trapped under the flexible skin-engaging projections 112 might be pushed flat against the surface of the skin The second elongated gap 108 may be provided to facilitate the release of any hair that might be pressed against the surface of the skin back to a more upright orientation as the hair passes to skin contacting bar 40. The second elongated gap 108 may have a width of about 0 mm, 0.1 mm or 0.2 mm to about 0.3 mm, 0.4 mm, or 0.5 mm In certain embodiments, the second elongated gap 108 may extend continuously along the length skin contacting bar 40 or the second elongated gap 108 may include segments that extend in a discontinuous manner along the length of the skin contacting bar 40

The flexible skin-engaging projections 112 may be aligned with the generally rigid projections 42, such that, a generally unobstructed passage for hair is provided with minimal tugging or pulling of hair. The generally rigid projections 42 of the skin contacting bar 40 may facilitate the management of skin and the guiding of hair to the first blade. The generally rigid projections 42 may also facilitate the lifting of hairs from the surface of the skin. Adjacent generally rigid projections 42 may be spaced apart to define the open channel 44 that is dimensioned to facilitate the generally unobstructed passage of hair to the first blade with minimal pulling or tugging of the hair, which may result in discomfort. The open channels 44 may also be dimensioned to reduce skin bulges and pressure points at ends of the generally rigid projections 42, which may result if the spacing is too great between adjacent generally rigid projections 42. For example, if the generally rigid projections 42 are spaced too far apart, skin may bulge into the open channel 44 which may result in the skin being unnecessarily sliced or cut by one or more of the blades. In certain embodiments, the generally rigid projections 42 may be spaced apart (i.e., the open channel 44) by a dimension "$d_2$" of about 0.10 mm, 0.20 mm or 0.30 mm to about 0.35 mm, 0.40 mm, or 0.49 mm, however $d_2$ may be larger or smaller depending on the thickness and amount of hair passing through the open channels 44. Improper spacing may result in inferior rinsability as well as discomfort caused by pressure points, skin bulges and/or the pulling of hair.

The generally rigid projections 42 may be sufficiently rigid such that the geometry of the open channels 44 remains consistent during shaving, thus maintaining optimum blade-skin geometry resulting in a closer and more comfortable shave. A top face of the skin contacting bar 40 may be generally flat for improved management of skin flow and increased comfort. In certain embodiments, the generally rigid projections 42 may have a width "$w_4$" that is generally equivalent to $d_2$. For example, the $w_4$ may be about 0.10 mm, 0.20 mm, or 0.30 mm to about 0.35 mm, 0.40 mm, or 0.49 mm, however $w_4$ may also be larger or smaller depending on the desired total contact area with the skin surface. The open channels 44 defined by the generally rigid projections 42 may be generally aligned with the open channels 114 defined by the flexible skin-engaging projections 112 such that hair is allowed to pass generally unobstructed from the elongated resilient skin contacting element 60 to the first blade. In certain embodiments, $d_1$ and $w_3$ may be generally the same as $d_2$ and $w_4$ (respectively) to facilitate the unobstructed passage of hair to the blades. The dimensions of generally rigid projections 42, the open channels 44, the flexible skin-engaging projections 112, and the open channels 114 may allow for an optimal balance of skin management, comfort, hair orientation, and rinsability.

The generally rigid projections 42 may have a length $L_5$ of about 0.5 mm, 1 mm, or 1.75 mm to about 2 mm, 3 mm, or 4 mm The generally rigid projections 42 may align the hair better than the flexible skin-engaging projections 112, however the generally rigid projections 42 may be uncomfortable to some users during shaving. In certain embodiments, $L_5$ may be minimized to decrease the drag and any discomfort of the generally rigid projections 42 against the skin while still allowing sufficient hair orientation. The flexible skin-engaging projections 112 may have a more pleasant tactile feel against the skin, which may mask the drag and discomfort of the generally rigid projections 42. The flexible skin-engaging projections 112 may have a length "$L_6$" that is greater than $L_5$, to provide for improved skin stretching, enhanced tactile sensation and improved hair orientation. In certain embodiments, $L_6$ may be about 1.0 mm, 1.5 mm, or 2.0 mm to 2.5 mm, 3.0 mm, or 4.0 mm.

Figure 4B:
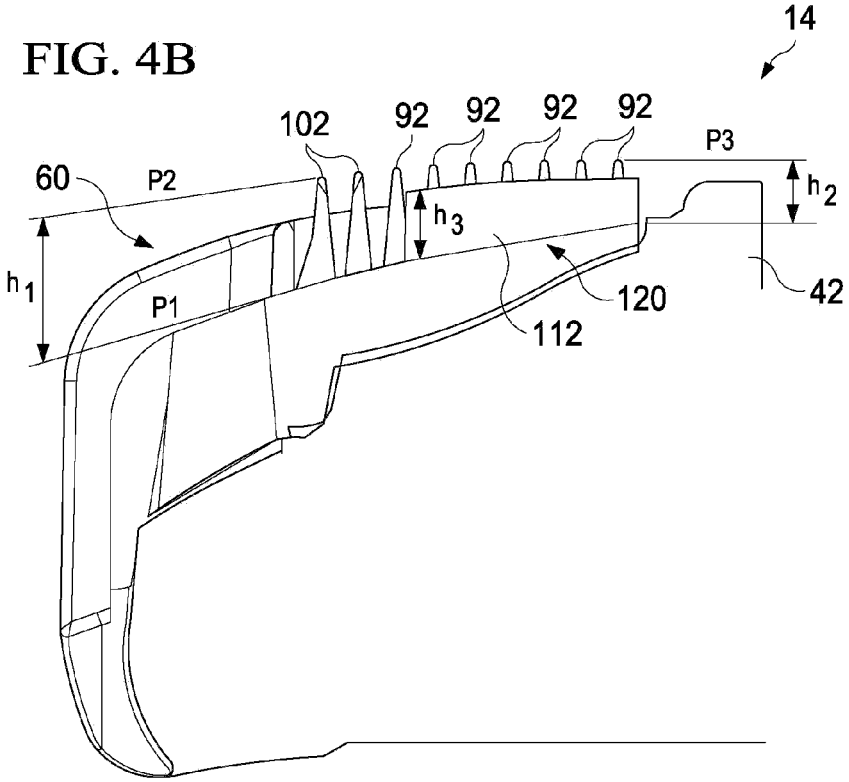
FIG. 4B is a partial cross section view of the cartridge, taken generally along the line 4-4 of FIG. 2.

Referring to FIG. 4B the flexible skin-engaging projections 82 (not shown), 92 and 102, and 112 may extend from a base 120 of the elongated resilient skin contacting element 60. The base 120 may be inclined along a generally curved plane P1. A top surface of the flexible skin-engaging projections 102 may be oriented along a generally inclined curved plane P2. The flexible skin-engaging projections 102 may have a height $h_1$, as measured from P1 to P2, of about 0.25 mm, 0.50 mm, or 0.75 mm to about 1.0 mm, 1.25 mm, or 2 mm. A top surface of the flexible skin-engaging projections 82 and 92 may be oriented along a generally inclined curved plane P3. The flexible skin-engaging projections 82 and 92 may have a height $h_2$, as measured from P1 to P3, of about 0.1 mm, 0.25 mm, or 0.5 mm to about 0.75 mm, 1.0 mm, or 1.5 mm As shown in FIG. 4B, the flexible skin-engaging projections 82 and 92 may extend above the flexible skin-engaging projections 112 to provide additional skin stretching at the lateral end portions of the cartridge 14. In certain embodiments, $h_1$ may be greater than $h_2$, to provide the flexible skin-engaging projections 102 with increased flexibility and skin stretching properties. It is understood that due to the possible inclines of planes P1, P2 and P3, the height (h1, h2 and h3) of the individual flexible skin-engaging projections 82 (not shown) and 92 and 102 may vary along the elongated resilient skin contacting element 60

The generally rigid projections 42 and the flexible skin-engaging projections 112 may have generally the same height (i.e., positioned on the same plane), such that the rigid projections 42 and the flexible skin-engaging projections 112 both contact the skin as the cartridge 14 is placed against the surface of the skin. In certain embodiments, the flexible skin-engaging projections 112 may be positioned slightly above the generally rigid projections 42 to allow for compression of the flexible skin-engaging projections 112 against the surface of the skin for an improved tactile feel to the user, as well as mask the feel of the generally rigid projections 42. A top surface of the flexible skin-engaging projections 112 may be oriented along a generally inclined curved plane. In certain embodiments, the flexible skin-engaging projections 112 may have a height $h_3$ (as measured from the base 120 to the top surface of the flexible skin-engaging projections 112) of about 0.2 mm, 0.3 mm, or 0.4 mm to about 0.7 mm, 0.9 mm, or 1.2 mm In alternative embodiments, the top surface of the flexible skin-engaging projections 112 and the planes P1 and P2 may be inclined along a generally straight planes or may not be straight.

Figure 5A:
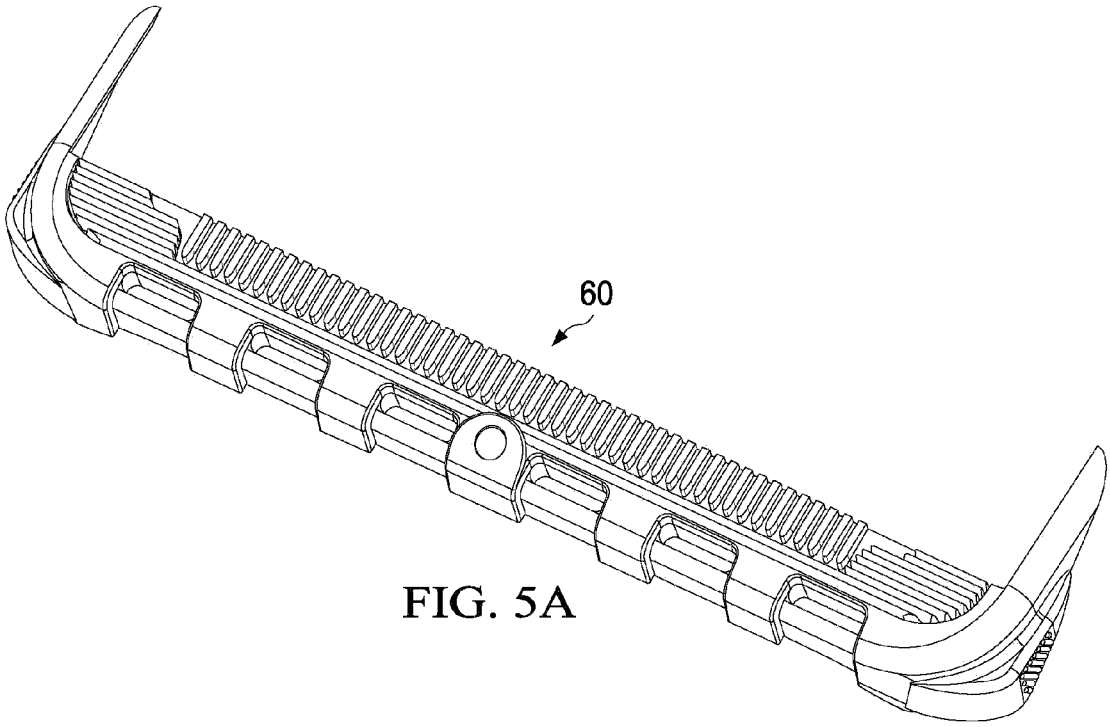
FIG. 5A is a perspective view of the elongated resilient skin contacting element of FIG. 3.
Figure 5B:
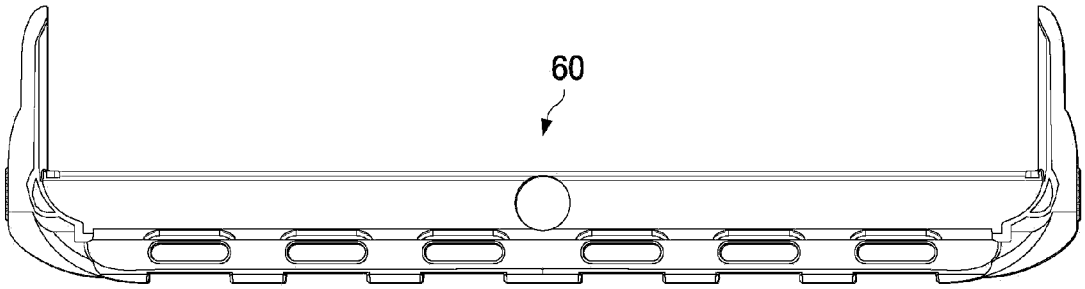
FIG. 5B is a bottom view of the elongated resilient skin contacting element of FIG. 3.
Figure 5C:
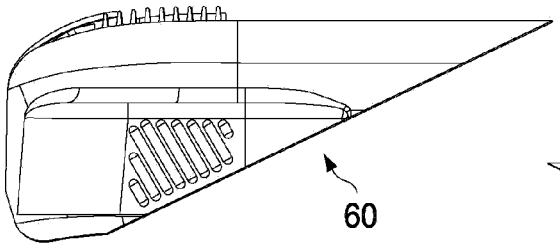
FIG. 5C is a right view of the elongated resilient skin contacting element of FIG. 3.
Figure 5D:
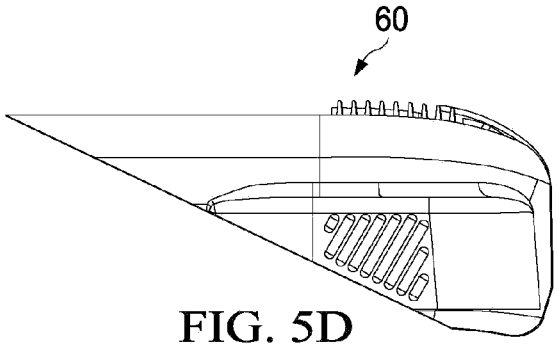
FIG. 5D is a left view of the elongated resilient skin contacting element of FIG. 3.
Figure 5E:
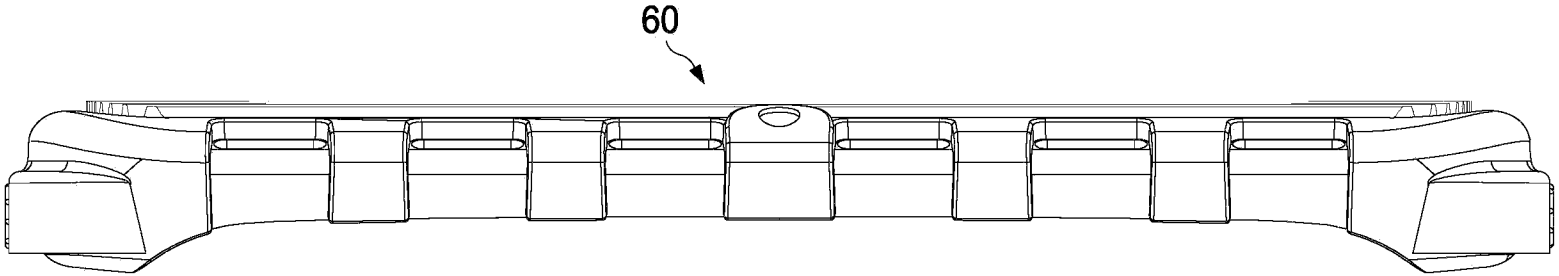
FIG. 5E is a front view of the elongated resilient skin contacting element of FIG. 3.
Figure 5F:
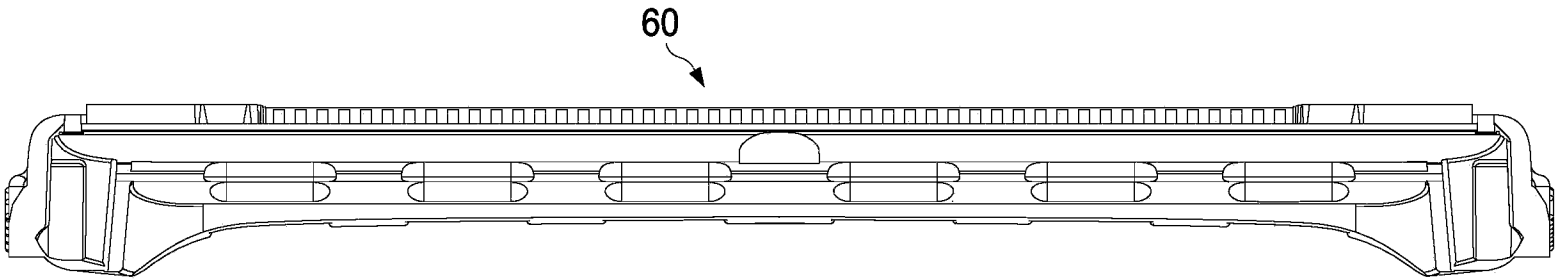
FIG. 5F is a rear view of the elongated resilient skin contacting element of FIG. 3.

FIGS. 5A-5F illustrate various views of the elongated resilient skin contacting element 60. FIG. 5A is a perspective view of the elongated resilient skin contacting element 60. FIG. 5B is a bottom view of the elongated resilient skin contacting element 60. FIG. 5C is a right view of the elongated resilient skin contacting element 60. FIG. 5D is a left view of the elongated resilient skin contacting element 60, which is a mirror image of FIG. 5C. FIG. 5E is a front view of the elongated resilient skin contacting element 60. FIG. 5F is a rear view of the elongated resilient skin contacting element 60.

A method of cutting hair may also be provided for a closer and more comfortable shave. The method may include providing a shaving razor cartridge with at least one blade and an elongated resilient skin contacting element in front of the at least one blade. A first area of skin in front of the blade may be stretched with the elongated resilient skin contacting element to reduce skin bulging. A plurality of hairs behind the first area being stretched may be aligned with the elongated resilient skin contacting element, whereby the hairs are aligned generally perpendicular to the at least one blade. The alignment of hair may facilitate the hair being cut consistently and evenly by the one or more blades. Another area of skin lateral of the hairs being aligned may also be stretched with the elongated resilient skin contacting element. The area of skin that is lateral of the hairs being aligned may be behind or generally even with of the first area of skin. The generally aligned hairs may be cut with the one or more blades. The steps provided above may be performed in any order and certain steps may be repeated or may not be included at all.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" In an effort to avoid any ambiguity, for the purposes of this disclosure, the term "portion" shall be construed as meaning less than 50%. For example, the term "distal end portion" should be interpreted as from about 0%, 5%, 10%, or 15% to about 15%, 20%. 25%, 30%, 40% or 45% from the terminal end of the element referenced. Similarly, the term "proximal end portion" should be interpreted as from about 0%, 5%, 10%, or 15% to about 15%, 20%. 25%, 30%, 40% or 45% from the end opposite the terminal end of the element referenced.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising:

a housing having a proximal end portion and a distal end portion;

one or more blades mounted within the housing; and an elongated resilient skin contacting element joined to the proximal end portion of the housing, the elongated resilient skin contacting element comprising a pair of lateral arrays of skin contacting members;

an alignment array of skin contacting members positioned between and spaced apart from the pair of lateral arrays of skin contacting members and having a pattern of one or more flexible skin-engaging projections that are generally transverse to one or more of the blades and define a plurality of open channels that facilitate the generally unobstructed passage of hair to one or more of the blades during shaving, wherein the pair of lateral arrays of skin contacting members and the alignment array of skin contacting members are oriented at different angles with respect to the one or more blades.

2. The razor cartridge of claim 1 wherein the alignment array of skin contacting members has a different length than a length of at least one of the pair of lateral arrays of skin contacting members.

3. The razor cartridge of claim 2 wherein the alignment array of skin contacting members has a different width than a length of at least one of the pair of lateral arrays of skin contacting members.

4. The razor cartridge of claim 1 wherein the pair of lateral arrays of skin contacting members includes one or more flexible skin-engaging projections that is generally parallel to the blades.

5. The razor cartridge of claim 1 further comprising an elongated array of skin contacting members spaced apart from the skin-engaging projections of the alignment array to define a first elongated gap.

6. The razor cartridge of claim 1 wherein the elongated resilient skin contacting element and the housing are spaced apart to define a second elongated gap.

7. The razor cartridge of claim 1, wherein the elongated resilient skin contacting element has a proximal end portion and a distal end portion and the alignment array of skin contacting members is disposed at the distal end portion of the elongated resilient skin contacting element.

8. The razor cartridge of claim 7 wherein the additional array of skin contacting members is positioned at the proximal end portion of the elongated resilient skin contacting element.

* * * * *